US011258186B2

(12) United States Patent
Kim et al.

(10) Patent No.: US 11,258,186 B2
(45) Date of Patent: Feb. 22, 2022

(54) ANTENNA APPARATUS

(71) Applicant: Samsung Electro-Mechanics Co., Ltd., Suwon-si (KR)

(72) Inventors: Sang Hyun Kim, Suwon-si (KR); Jeong Ki Ryoo, Suwon-si (KR); Min Hoon Kim, Suwon-si (KR); Nam Ki Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 107 days.

(21) Appl. No.: 16/668,526

(22) Filed: Oct. 30, 2019

(65) Prior Publication Data

US 2020/0395680 A1 Dec. 17, 2020

(30) Foreign Application Priority Data

Jun. 13, 2019 (KR) ..... 10-2019-0069809

(51) Int. Cl.
*H01Q 1/38* (2006.01)
*H01Q 21/00* (2006.01)
*H01Q 21/06* (2006.01)

(52) U.S. Cl.
CPC ..... *H01Q 21/065* (2013.01); *H01Q 21/0006* (2013.01)

(58) Field of Classification Search
CPC .. H01Q 21/0006; H01Q 21/065; H01Q 21/06; H01Q 21/00; H01Q 9/04; H01Q 9/045; H01Q 9/16; H01Q 5/35; H01Q 1/38
See application file for complete search history.

(56) References Cited

U.S. PATENT DOCUMENTS 5,216,430 A * 6/1993 Rahm ..... H01Q 9/0435 343/700 MS
6,211,824 B1 * 4/2001 Holden ..... H01Q 1/523 343/700 MS
6,897,813 B2 * 5/2005 Higasa ..... H01Q 9/0435 343/700 MS
7,460,073 B2 * 12/2008 Schillmeier ..... G06K 7/10336 340/572.1
2019/0273325 A1 * 9/2019 Ryoo ..... H01Q 21/10

FOREIGN PATENT DOCUMENTS

JP 2008-283352 A 11/2008
KR 10-2009-0065229 A 6/2009

* cited by examiner

*Primary Examiner* — Tho G Phan
(74) *Attorney, Agent, or Firm* — NSIP Law

(57) ABSTRACT

An antenna apparatus includes a plurality of patch antenna patterns, a plurality of first feed vias each electrically connected to a corresponding patch antenna pattern among the plurality of patch antenna patterns, and a plurality of first feed lines each electrically connected to a corresponding first feed via among the plurality of first feed vias. Each of the first feed vias is electrically connected to the corresponding patch antenna pattern at a point offset from a center of the corresponding patch antenna pattern in a first direction. An angle between a direction in which each of at least one of the plurality of first feed lines starts to extend from the corresponding first feed via and a direction in which each of remaining ones of the plurality of first feed lines starts to extend from the corresponding first feed via is not zero degrees and is not 180 degrees.

13 Claims, 13 Drawing Sheets

ANTENNA APPARATUS

CROSS-REFERENCE TO RELATED APPLICATION

This application claims the benefit under 35 USC 119(a) of Korean Patent Application No. 10-2019-0069809 filed on Jun. 13, 2019, in the Korean Intellectual Property Office, the entire disclosure of which is incorporated herein by reference for all purposes.

BACKGROUND

1. Field

This application relates to an antenna apparatus.

2. Description of Related Art

Mobile communications data traffic is increasing rapidly every year. Active technological development is underway to support the transmission of such rapidly increased data in real time in wireless networks. For example, the contents of Internet of things (IoT) based data, augmented reality (AR), virtual reality (VR), live VR/AR combined with social networking services (SNS), autonomous navigation, and applications such as Sync View (real-time video transmissions of users using ultra-small cameras) necessitate communications (for example, 5G communications and mmWave communications) supporting the transmission and reception of large amounts of data.

Recently, millimeter wave (mmWave) communications, including 5th generation (5G) communications, have been actively researched, and research into the standardization and commercialization of an antenna apparatus effective for performing such communications is actively progressing.

Since radio-frequency (RF) signals in high frequency bands (for example, 24 GHz, 28 GHz, 36 GHz, 39 GHz, and 60 GHz) are easily absorbed and lost in the course of the transmission thereof, the quality of communications using such RF signals may be dramatically reduced. Therefore, antennas for communications in high frequency bands may necessitate different approaches from those of conventional antenna technology, and a separate approach may necessitate additional special technologies, such as separate power amplifiers for providing a sufficient antenna gain, integrating an antenna and a radio-frequency integrated circuit (RFIC), and achieving a sufficient effective isotropic radiated power (EIRP).

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a antenna apparatus includes a plurality of patch antenna patterns; a plurality of first feed vias each electrically connected to a corresponding patch antenna pattern among the plurality of patch antenna patterns; and a plurality of first feed lines each electrically connected to a corresponding first feed via among the plurality of first feed vias, wherein each of the plurality of first feed vias is electrically connected to the corresponding patch antenna pattern at a point offset from a center of the corresponding patch antenna pattern in a first direction, and an angle between a direction in which each of at least one of the plurality of first feed lines starts to extend from the corresponding first feed via and a direction in which each of remaining ones of the plurality of first feed lines starts to extend from the corresponding first feed via is not zero degrees and is not 180 degrees.

The antenna apparatus may further include a plurality of first wiring vias each electrically connected to a corresponding first feed line among the plurality of first feed lines; and an integrated circuit (IC) electrically connected to the plurality of first wiring vias.

The antenna apparatus may further include a plurality of second feed vias each electrically connected to a corresponding patch antenna pattern among the plurality of patch antenna patterns, wherein each of the plurality of second feed vias may be electrically connected to the corresponding patch antenna pattern at a point offset from the center of the corresponding patch antenna pattern in a second direction different from the first direction.

The antenna apparatus may further include a plurality of second feed lines each electrically connected to a corresponding feed via among the plurality of second feed vias, wherein an angle between a starting direction in which at least one of the plurality of second feed lines extends from the corresponding second feed via and a starting direction in which at least other one of the plurality of second feed lines extends from the corresponding second feed via may not be zero degrees and may not be 180 degrees.

The direction in which the least one of the plurality of first feed lines starts to extend from the corresponding first feed via and the direction in which the at least other one of the plurality of first feed lines starts to extend from the corresponding first feed via may be perpendicular to each other and perpendicular to the plurality of first feed vias.

The antenna apparatus may further include a plurality of side coupling patterns disposed in a second direction together with the plurality of patch antenna patterns, wherein each of at least one of the plurality of first feed lines may start to extend from the corresponding first feed via in the second direction.

The antenna apparatus may further include a ground plane disposed between the plurality of patch antenna patterns and the plurality of first feed lines and including a plurality of through-holes through which the plurality of first feed vias respectively penetrate.

The antenna apparatus may further include a plurality of upper coupling patterns respectively spaced apart from the plurality of patch antenna patterns in an upward direction, wherein the plurality of first feed vias may respectively extend from the plurality of patch antenna patterns in a downward direction.

The antenna apparatus may further include a plurality of side coupling patterns disposed in a second direction together with the plurality of patch antenna patterns and the plurality of upper coupling patterns, wherein some of the plurality of side coupling patterns may be disposed at a same height as the plurality of patch antenna patterns, and remaining ones of the plurality of side coupling patterns may be disposed at same heights as the plurality of upper coupling patterns.

The plurality of patch antenna patterns may include at least four patch antenna patterns, and may be divided into a first group of patch antenna patterns and a second group of patch antenna patterns, and an angle between a direction in which of each of the first feed lines corresponding to the patch antenna patterns of the first group extends from the corresponding first feed via and a direction in which each of the first feed lines corresponding to the patch antenna patterns of the second group extends from the corresponding first feed via may not be zero degrees and may not be 180 degrees.

A direction in which at least one of the first feed lines corresponding to the patch antenna patterns of the first group extends from the corresponding first feed via may be opposite to a direction in which each of remaining ones of the first feed lines corresponding to the patch antenna patterns of the first group extends from the corresponding first feed via, a direction in which at least one of the first feed lines corresponding to the patch antenna patterns of the second group extends from the corresponding first feed via may be opposite to a direction in which each of remaining ones of the first feed lines corresponding to the patch antenna patterns of the second group extends from the corresponding first feed via, and the directions in which the first feed lines corresponding to the patch antenna patterns of the first group extend from the corresponding first feed vias may be perpendicular to the directions in which the first feed lines corresponding to the patch antenna patterns of the second group extend from the corresponding first feed vias.

The antenna apparatus may further include a plurality of coupling feed lines; and a plurality of first wiring vias, wherein each of at least one of the coupling feed lines may electrically connect a respective two of the first feed lines corresponding to the patch antenna patterns of the first group and extending in opposite directions from the corresponding first feed vias to a respective one of the first wiring vias, and each of remaining ones of the coupling feed lines may electrically connect a respective two of the first feed lines corresponding to the patch antenna patterns of the second group and extending in opposite directions from the corresponding first feed vias to a respective one of the first wiring vias.

The plurality of patch antenna patterns may be disposed in an N×M matrix structure, where N may be a positive integer greater than or equal to 3, and M may be a positive integer greater than or equal to 2, and the first group of patch antenna patterns may include at least one of a (1,1)-th patch antenna pattern of the N×M matrix structure, a (1,N)-th patch antenna pattern of the N×M matrix structure, an (M,1)-th patch antenna pattern of the N×M matrix structure, and an (M,N)-th patch antenna pattern of the N×M matrix structure.

In another general aspect, an antenna apparatus includes a plurality of patch antenna patterns; a plurality of feed vias each having one end electrically connected to a corresponding one of the plurality of patch antenna patterns and configured to supply a vertical feed energy component to the corresponding patch antenna pattern; and a plurality of feed lines each having one end electrically connected to another end of a corresponding one of the plurality of feed vias, wherein the plurality of patch antenna patterns are divided into a first group of patch antenna patterns and a second group of patch antenna patterns, each feed line of the feed lines corresponding to the patch antenna patterns of the first group of patch antenna patterns is configured to supply a horizontal feed energy component to the corresponding feed via only in a first direction or in a direction opposite to the first direction, and each feed line of the feed lines corresponding to the patch antenna patterns of the second group of the patch antenna patterns is configured to supply a horizontal feed energy component to the corresponding feed via only in a second direction perpendicular to the first direction or in a direction opposite to the second direction.

The plurality of patch antenna patterns may be disposed in an N×M matrix structure, where N is a positive integer greater than or equal to 3, and M is a positive integer greater than or equal to 2, and the first group of patch antenna patterns may include at least one of a (1,1)-th patch antenna pattern, a (1,N)-th patch antenna pattern, an (M,1)-th patch antenna pattern, and an (M,N)-th patch antenna pattern of the N×M matrix structure.

The antenna apparatus may further include a plurality of side coupling patterns disposed only in the first direction or only in the second direction so that each of the plurality of patch antenna patterns has two corresponding ones of the side coupling patterns disposed on opposite sides of the patch antenna pattern only in the first direction or only in the second direction.

In another general aspect, an antenna apparatus includes a plurality of patch antenna patterns disposed in either one or both of a first direction and a second direction perpendicular to the first direction; a plurality of feed vias extending in a third direction perpendicular to the first direction and the second direction; and a plurality of feed lines, wherein each of the feed vias includes a first end and a second end, and the first end of each of the feed vias is electrically connected to a corresponding patch antenna pattern among the patch antenna patterns at a feed point of the corresponding patch antenna pattern, each of the feed lines includes a first end and a second end, and the first end of each of the feed lines is electrically connected to the second end of a corresponding feed via among the feed vias, each of at least one of the feed lines starts to extend from the second end of the corresponding feed via in a first starting direction perpendicular to the third direction or in a direction opposite to the first starting direction, each of all remaining ones of the feed lines starts to extend from the second end of the corresponding feed via in a second starting direction perpendicular to the third direction or in a direction opposite to the second starting direction, and the second starting direction is different from the first starting direction and is not opposite to the first starting direction.

An angle between the first starting direction and the second starting direction may be substantially 90 degrees.

The feed point of each of the patch antenna patterns may be offset from a center of the patch antenna pattern by a predetermined distance in a predetermined direction, the predetermined distance may be the same for all of the feed points, and the predetermined direction may be the same for all of the feed points.

The patch antenna patterns may be disposed in an N×M matrix structure, where N is a positive integer greater than or equal to 4, and M is a positive even integer greater than or equal to 4, the first starting direction may be the first direction, the direction opposite to the first starting direction may be a direction opposite to the first direction, the second starting direction may be the second direction, the direction opposite to the second starting direction may be a direction opposite to the second direction, the at least one of the feed lines may respectively correspond to (1,1)-th, (1,2)-th, (1,N−1)-th, (1,N)-th, (M,1)-th, (M,2)-th, (M,N−1)-th, and (M,N)-th patch antenna patterns of the N×M matrix structure, the all remaining ones of the feed lines may respectively correspond to all remaining ones of the patch antenna patterns of the N×M matrix structure, each of the feed lines corresponding to the (1,1)-th, (1,N−1)-th, (M,1)-th, and (M,N−1)-th patch antenna patterns may start to extend from the second end of the corresponding feed via in the first direction, each of the feed lines corresponding to the (1,2)-th, (1,N)-th, (M,2)-th, and (M,N)-th patch antenna patterns may start to extend from the second end of the corresponding feed via in the direction opposite to the first direction, the remaining ones of the patch antenna patterns may be divided into pairs of patch antenna patterns, the patch antenna patterns in each of the pairs may be adjacent to each other in the second direction, the feed line corresponding to a first patch antenna pattern in each of the pairs may start to extend from the second end of the corresponding feed via in the second direction toward a second patch antenna pattern in the pair, and the feed line corresponding to the second patch antenna pattern in each of the pairs may start to extend from the second end of the corresponding feed via in the direction opposite to the second direction toward the first patch antenna pattern in the pair.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
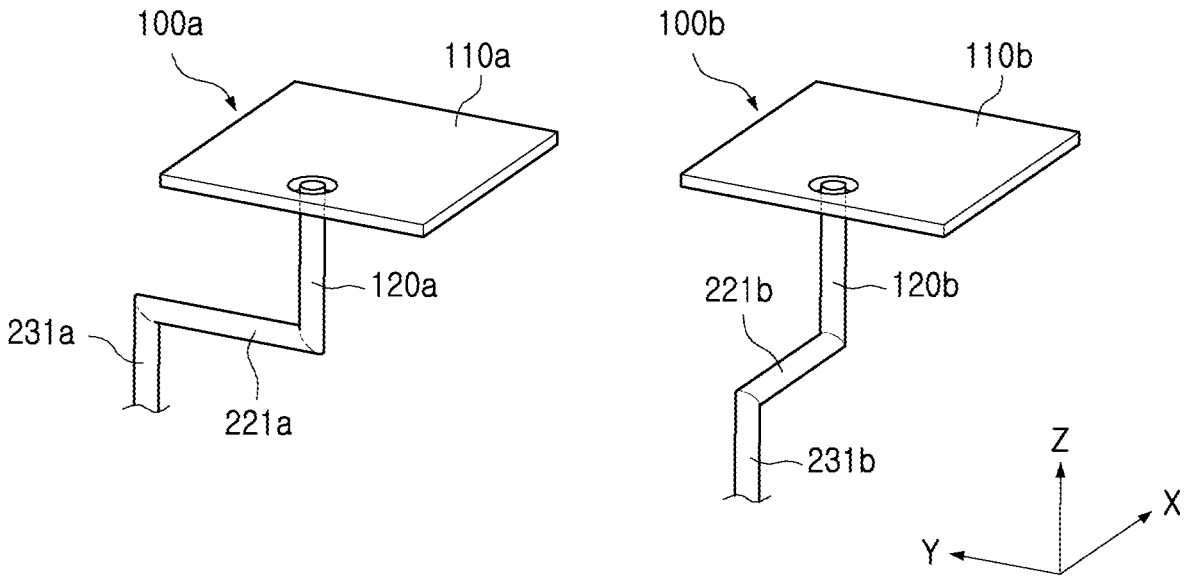
FIG. 1A is a perspective view illustrating an example of an antenna apparatus.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

The features of the examples described herein may be combined in various ways as will be apparent after an understanding of the disclosure of this application. Further, although the examples described herein have a variety of configurations, other configurations are possible, as will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated by 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

FIG. 1A is a perspective view illustrating an example of an antenna apparatus.

Referring to FIG. 1A, an antenna apparatus includes a plurality of patch antenna patterns 110*a* and 110*b*, a plurality of first feed vias 120*a* and 120*b*, a plurality of first feed lines 221*a* and 221*b*, and a plurality of first wiring vias 231*a* and 231*b*. The antenna apparatus is divided into first and second antenna portions 100*a* and 100*b*.

Each of the plurality of patch antenna patterns 110*a* and 110*b* transmits and receives a radio-frequency (RF) signal, and forms a radiation pattern in the vertical direction (the Z direction in FIG. 1A).

The RF signals are transmitted from an integrated circuit (IC) (not shown) to the plurality of patch antenna patterns 110*a* and 110*b* during transmission thereof, and are transmitted from the plurality of patch antenna patterns 110*a* and 110*b* to the IC during reception thereof.

The greater the number of the plurality of patch antenna patterns 110*a* and 110*b*, the higher a gain of the plurality of patch antenna patterns 110*a* and 110*b*. However, the greater the number of the plurality of patch antenna patterns 110*a* and 110*b*, the more complex the electrical paths between the plurality of patch antenna patterns 110*a* and 110*b* and the IC. The more complex the electrical paths, the greater an overall transmission loss of the electrical paths.

A phase difference between the RF signals of the plurality of patch antenna patterns 110*a* and 110*b* may be controlled by performing beamforming in the IC, or may be determined by a difference between the electrical lengths of the electrical paths between the plurality of patch antenna patterns 110*a* and 110*b* and the IC. The closer the phase difference is to a design phase difference, the higher the gain and the directivity of the plurality of patch antenna patterns. The complexity of the electrical paths between the plurality of patch antenna patterns 110*a* and 110*b* and the IC may cause the phase difference to differ from the design phase difference.

Each of the plurality of first feed vias 120*a* and 120*b* is electrically connected to a corresponding patch antenna pattern among the plurality of patch antenna patterns 110*a* and 110*b*.

The plurality of patch antenna patterns 110*a* and 110*b* and the plurality of feed lines 221*a* and 221*b* may be disposed at different heights relative to each other. Thus, a size of each of the patch antenna patterns 110*a* and 110*b* may be reduced as compared with the number of the patch antenna patterns 110*a* and 110*b*, and the electrical paths between the plurality of patch antenna patterns 110*a* and 110*b* and the IC may be further simplified. The simplification of the electrical paths reduces the overall transmission loss of the electrical paths, and causes the phase difference between RF signals transmitted and received by the plurality of antenna patterns 110*a* and 110*b* to become closer to the design phase difference. As a result, the gain and the directivity of the plurality of patch antenna patterns 110*a* and 110*b* is improved.

The plurality of first feed vias 120*a* and 120*b* are connected to the plurality of patch antenna patterns 110*a* and 110*b* in the vertical direction (the Z direction).

An RF signal radiated from each of the plurality of patch antenna patterns 110*a* and 110*b* propagates in the vertical direction (the Z direction) perpendicular to a surface current of each of the plurality of patch antenna patterns 110*a* and 110*b*. The RF signal propagating in the vertical direction generates an electric field in a first direction (for example, the X direction in FIG. 1A) perpendicular to the vertical direction (the Z direction), and generates a magnetic field in a second direction (for example, the Y direction in FIG. 1A) perpendicular to both the vertical direction (the Z direction) and the first direction (the X direction).

The gain and the directivity of the plurality of patch antenna patterns 110*a* and 110*b* increase the more similar the directions of the electric fields generated by the plurality of patch antenna patterns 110*a* and 110*b* are to each other and the more similar the directions of the magnetic fields generated by the plurality of patch antenna patterns 110*a* and 110*b* are to each other.

Each of the plurality of first feed vias 120*a* and 120*b* is electrically connected to a corresponding patch antenna pattern among the plurality of patch antenna patterns 110*a* and 110*b* at a point that is offset from a center of the corresponding patch antenna pattern in a first direction (for example, the X direction).

Accordingly, most of the surface current of each of the plurality of patch antenna patterns 110*a* and 110*b* corresponding to the plurality of first feed vias 120*a* and 120*b* flows in the first direction or in a direction opposite to the first direction. Therefore, the similarity of the magnetic field directions and the electric field directions of the plurality of patch antenna patterns 110*a* and 110*b* is increased, and the gain and the directivity of the plurality of patch antenna patterns 110*a* and 110*b* is increased.

Each of the plurality of first feed lines 221*a* and 221*b* is electrically connected to a corresponding first feed via among the plurality of first feed vias 120*a* and 120*b*. The plurality of feed lines 120*a* and 120*b* electrically connect the plurality of first feed vias 120*a* and 120*b* to the plurality of first wiring vias 231*a* and 231*b* to form electrical paths for the RF signals. The plurality of first wiring vias 231*a* and 231*b* electrically connect the plurality of first feed lines 221*a* and 221*b* to the IC.

For example, the plurality of first feed lines 221*a* and 221*b* are disposed in an X-Y plane.

Electrical connection directions of the plurality of first feed lines 221*a* and 221*b* to the plurality of first feed vias 120*a* and 120*b* correspond to transmission directions of the RF signals in the plurality of first feed lines 221*a* and 221*b*.

Electrical connection points between the plurality of first feed lines 221*a* and 221*b* and the plurality of first feed vias 120*a* and 120*b* are points at which the transmission directions of the RF signals are bent from horizontal directions (for example, the X direction and the Y direction) to the vertical direction (for example, the Z direction)

The higher the frequency of the RF signals, the closer the characteristics of the RF signals are to the characteristics of light, and the more difficult it is to change the transmission directions of the RF signals. Accordingly, the RF include horizontal vector components corresponding to the transmission directions of the RF signals in the plurality of first feed lines 221*a* and 221*b* when the RF signals enter the plurality of first feed vias 120*a* and 120*b* from the plurality of first feed lines 221*a* and 221*b*.

The horizontal vector components gradually change into a vertical vector component as the RF signals propagate from the electrical connection points between the plurality of first feed lines 221*a* and 221*b* and the plurality of feed vias 120*a* and 120*b* to the plurality of patch antenna patterns 110*a* and 110*b* but may reach the plurality of patch antenna patterns 110*a* and 110*b* before they have completely changed into the vertical vector component. The shorter the electrical lengths of the plurality of first feed vias 120*a* and 120*b*, the greater the energy of the horizontal vector components reaching the plurality of patch antenna patterns 110*a* and 110*b*.

The energy of the horizontal vector components reaching the plurality of patch antenna patterns 110*a* and 110*b* affects the directions of the surface currents of the plurality of patch antenna patterns 110*a* and 110*b*. Accordingly, the directions of the surface currents of the plurality of patch antenna patterns 110*a* and 110*b* are affected by the electrical connection directions of the plurality of the first feed lines 221*a* and 221*b* to the plurality of first feed vias 120*a* and 120*b*, i.e., by the directions in which the plurality of first feed lines 221*a* and 221*b* start to extend from the corresponding first feed vias 120*a* and 120*b*.

An angle between the directions in which the plurality of first feed lines 221*a* and 221*b* start to extend from the corresponding first feed vias 120*a* and 120*b* is not zero degrees and is not 180 degrees.

For example, the first feed line 221*a* of the first antenna portion 100*a* is electrically connected to the first feed via 120*a* in a second direction (for example, the Y direction), and the first feed line 221*b* of the second antenna portion 100*b* is electrically connected to the first feed via 120*b* in the first direction (for example, the X direction). Thus, in this example, an angle between the direction in which the first feed line 221*a* starts to extend from the first feed via 120*a* and the direction in which the first feed line 221*b* starts to extend from the first feed via 120*b* is 90 degrees. However, due to variations in manufacturing, the angle might be slightly less than 90 degrees, or might be slightly more than 90 degrees. Thus, the angle may be substantially 90 degrees.

Accordingly, a first effect of an electrical connection direction of the first feed line 221*a* of the first antenna portion 100*a* to the first feed via 120*a* on the surface current of the patch antenna pattern 110*a* is different from a second effect of an electrical connection direction of the first feed line 221*b* of the second antenna portion 100*b* to the first feed via 120*b* on the surface current of the patch antenna pattern 110*b*.

Since the first effect and the second effect are different from each other, a side lobe in a radiation pattern generated by the plurality of patch antenna patterns 110*a* and is reduced or eliminated as will be explained later with respect to FIGS. 5A and 5B.

Figure 1B:
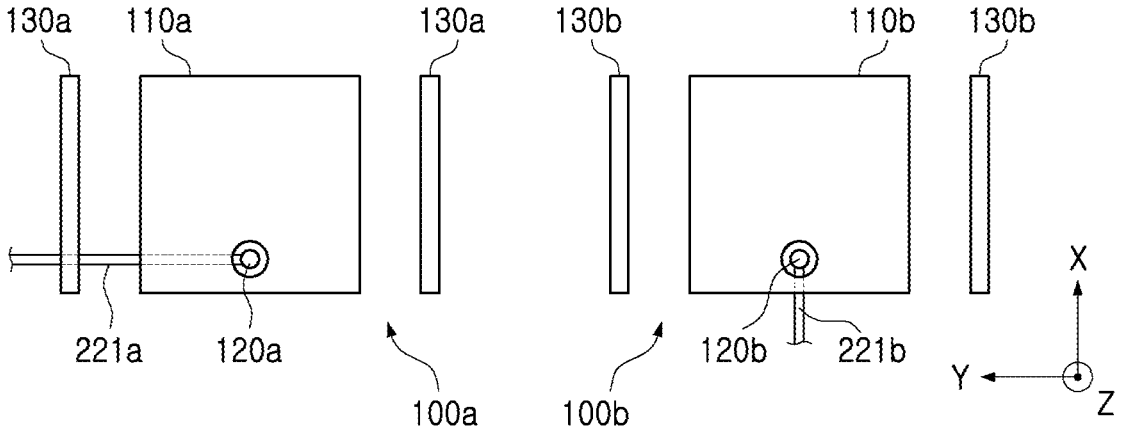
FIG. 1B is a top view illustrating a modified example of the antenna apparatus of FIG. 1A further including side coupling patterns.

FIG. 1B is a top view illustrating a modified example of the antenna apparatus of FIG. 1A further including side coupling patterns.

Referring to FIG. 1B, the antenna apparatus of FIG. 1A further includes a plurality of side coupling patterns 130*a* and 130*b*.

The plurality of side coupling patterns 130*a* are disposed on opposite sides of the patch antenna pattern 110*a* and are electrically coupled to the patch antenna pattern 110*a*, and the plurality of side coupling patterns 130*b* are disposed on opposite sides of the patch antenna pattern 110*b* and are electrically coupled to the patch antenna pattern 110*b*.

The plurality of side coupling patterns 130*a* and 130*b* provide additional capacitance and inductance to the plurality of patch antenna patterns 110*a* and 110*b*. The additional capacitance and inductance provide an additional resonant frequency to each of the plurality of patch antenna patterns 110*a* and 110*b*, thereby increasing a bandwidth of each of the plurality of patch antenna patterns 110*a* and 110*b*.

In addition, the plurality of side coupling patterns 130*a* and 130*b* disposed together with the plurality of patch antenna patterns 110*a* and 110*b* in a second direction (the Y direction in FIG. 1B).

The plurality of side coupling patterns 130*a* and 130*b* help stabilize directions of surface currents of the plurality of patch antenna patterns 110*a* and 110*b*, thereby improving the gain and the directivity of the plurality of patch antenna patterns 110*a* and 110*b*.

FIG. 10 is a top view illustrating another modified example of the antenna apparatus of FIG. 1A further including second feed vias and second feed lines.

Referring to FIG. 10, the antenna apparatus further includes a plurality of second feed vias 122*a* and 122*b* and a plurality of second feed lines 222*a* and 222*b*.

Each of the plurality of second feed vias 122*a* and 122*b* is electrically connected to a corresponding patch antenna pattern among the plurality of patch antenna patterns 110*a* and 110*b* at a point that is offset from a center of the corresponding patch antenna pattern in a second direction (for example, the Y direction).

Accordingly, most of a second surface current of each of the plurality of patch antenna patterns 110*a* and 110*b* corresponding to the plurality of second feed vias 122*a* and 122*b* flows in the second direction (the Y direction) or in a direction opposite to the second direction, which is perpendicular to the direction of the first surface currents of the plurality of patch antenna patterns 110*a* and 110*b* corresponding to the plurality of first feed vias 120*a* and 120*b*.

When the first and second surface currents are perpendicular to each other, first and second electric fields corresponding to the first and second surface currents are perpendicular to each other, and first and second magnetic fields corresponding to the first and second surface currents are perpendicular to each other.

Accordingly, a first RF signal transmitted through the plurality of first feed vias 120*a* and 120*b* and a second RF signal transmitted through the plurality of second via vias 122*a* and 122*b* may be transmitted and received in parallel substantially without interfering with each other.

Each of the plurality of second feed lines 222*a* and 222*b* is electrically connected to a corresponding second feed via among the plurality of second feed vias 122*a* and 122*b*. An angle between the directions in which the plurality of second feed lines 222*a* and 222*b* start to extend from the corresponding second feed vias 122*a* and 122*b* is not zero degrees and is not 180 degrees.

Accordingly, side lobes generated by the plurality of patch antenna patterns 110*a* and 110*b* are more efficiently reduced or eliminated.

Figure 1C:
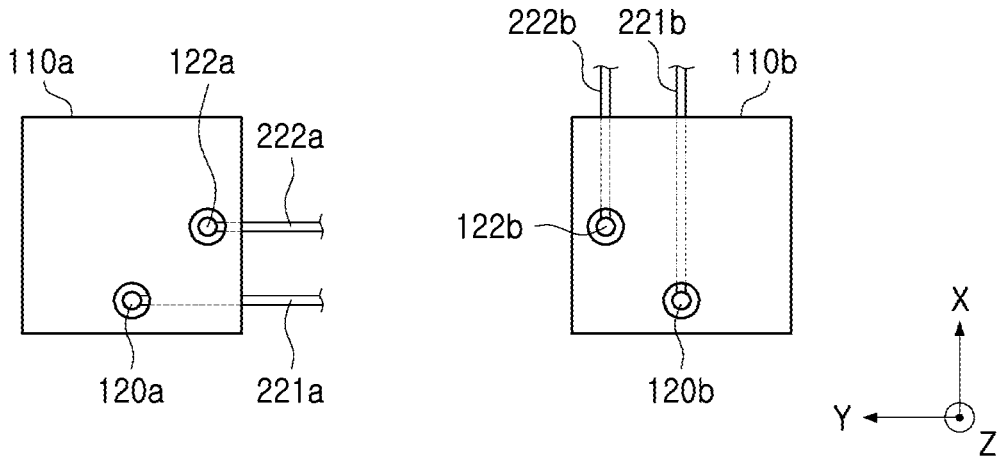
FIG. 1C is a top view illustrating another modified example of the antenna apparatus of FIG. 1A further including second feed vias and second feed lines.
Figure 1D:
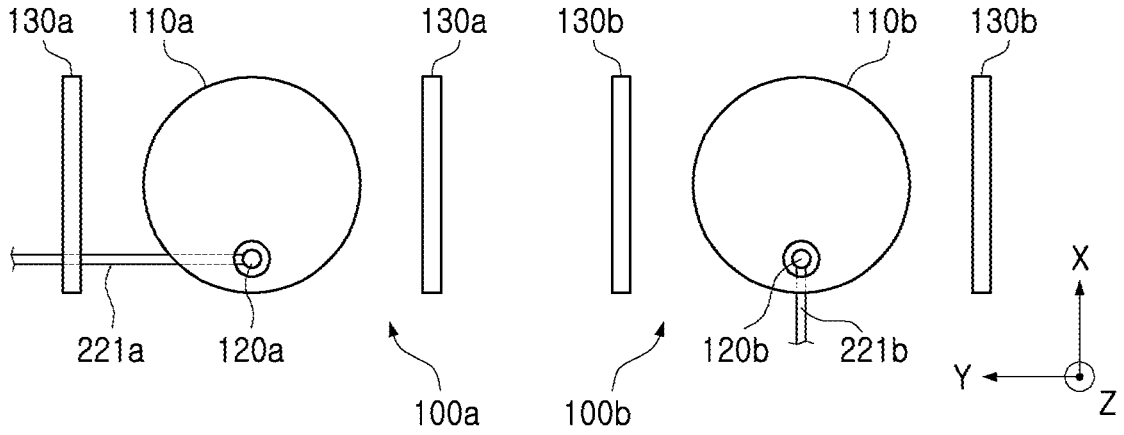
FIG. 1D is a top view illustrating a modified example of the antenna apparatus of FIG. 1B including circular patch antenna patterns.

FIG. 1D is a top view illustrating a modified example of the antenna apparatus of FIG. 1B including circular patch antenna patterns.

Referring to FIG. 1D, the plurality of patch antenna patterns 110*a* and 110*b* are circular, rather than rectangular as in FIGS. 1A to 1C.

Referring to FIGS. 1A to 1D, the plurality of patch antenna patterns 110*a* and 110*b* may be polygonal or circular depending on a design of the antenna apparatus.

Figure 1E:
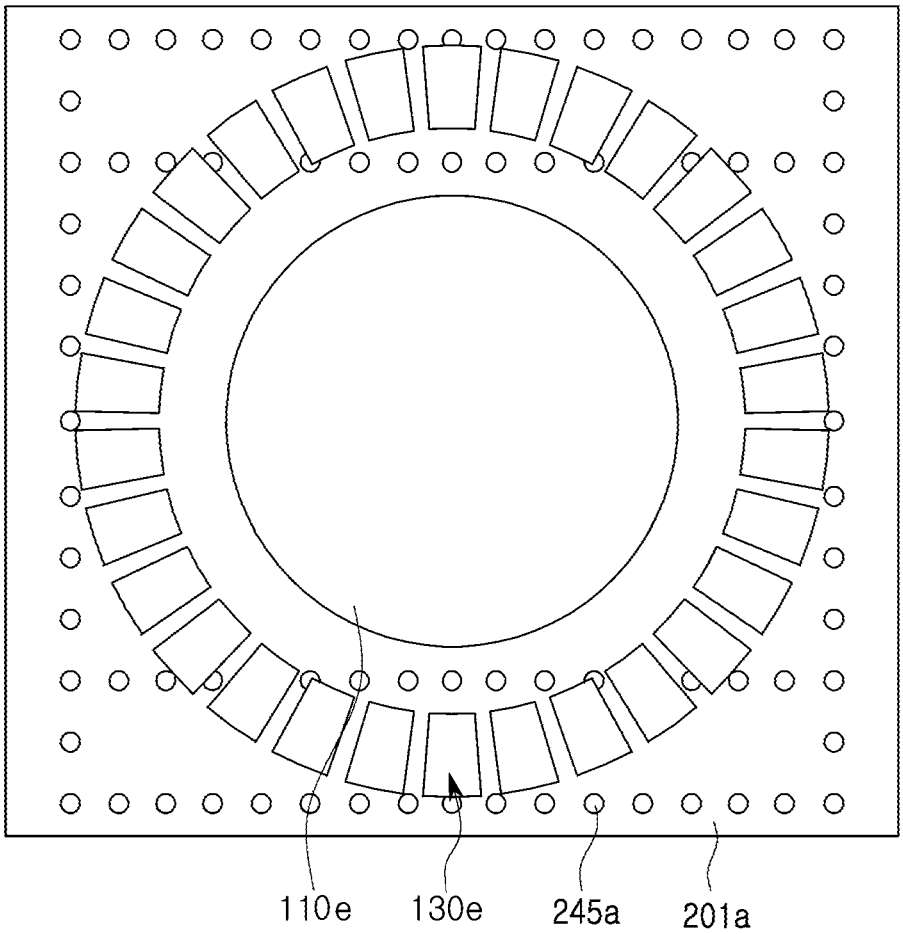
FIG. 1E is a top view illustrating a modified example of the antenna apparatus of FIG. 1D further including a ground plane and shielding vias.

FIG. 1E is a top view illustrating a modified example of the antenna apparatus of FIG. 1D further including a ground plane and shielding vias.

Referring to FIG. 1E, an antenna apparatus includes a circular patch antenna pattern 110*e* having a circular shape corresponding to one of the antenna patterns 110*a* and 110*b* of FIG. 1D, and a plurality of side coupling patterns 130*e* surrounding the patch antenna pattern 110*e* in a circular pattern corresponding to the circular shape of the patch antenna pattern 110*e* depending on a design of the antenna apparatus. The antenna apparatus further includes a ground plane 201*a* and shielding vias 245*a*.

Figure 2:
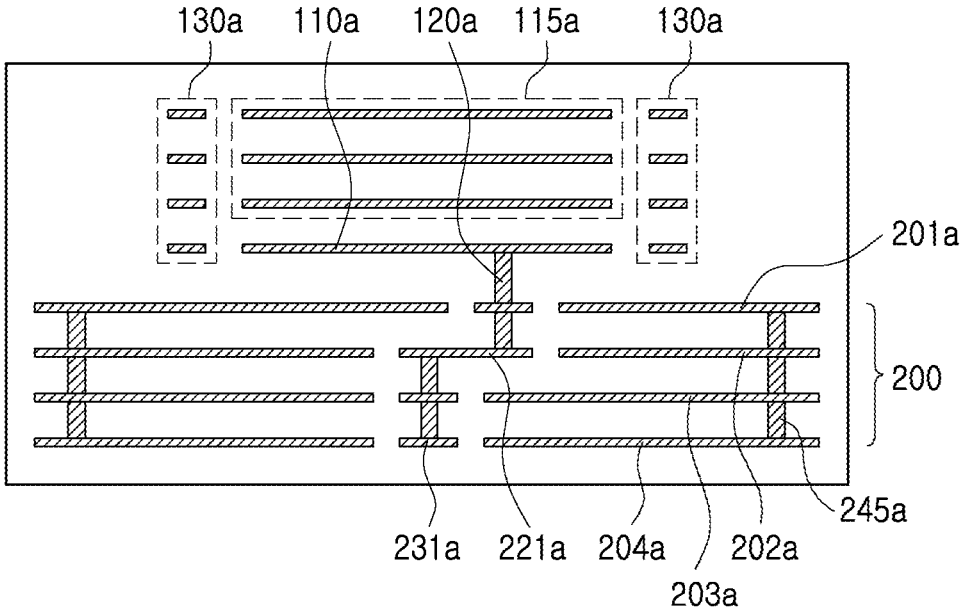
FIG. 2 is a side view of another example of an antenna apparatus including a connection member and an upper coupling pattern.

FIG. 2 is a side view illustrating another example of an antenna apparatus including a connection member and an upper coupling pattern.

Referring to FIG. 2, an antenna apparatus includes an antenna portion similar to the antenna portions 100*a* of FIGS. 1A and 1B, a connection member 200, and an upper coupling pattern 115*a*.

The antenna portion includes a patch antenna pattern 110*a*, a first feed via 120*a* having one end electrically connected to the patch antenna pattern 110*a*, a first feed line 221*a* having one end electrically connected to the other end of the first feed via 120*a*, a first wiring via 231*a* having one end electrically connected to the other end of the first feed line 221*a*, and two side coupling patterns 130*a* disposed on opposite sides of the patch antenna pattern 110*a*.

The connection member 200 includes a ground plane 201*a*, a second ground plane 202*a*, a third ground plane 203*a*, a fourth ground plane 204*a*, and shielding vias 245*a*. The ground plane 201*a* includes a through-hole through which the first feed via 120*a* penetrates. The second ground plane 202*a* includes a hole in which the first feed line 221*a* is disposed. The third ground plane 203*a* includes a through-hole through which the first wiring via 231*a* penetrates.

An IC corresponding to the IC discussed above in connection with FIG. 1A (not shown) is mounted on the bottom surface of the connection member 200. The IC is electrically connected to the first wiring via 231*a*.

The ground plane 201*a* including the through-hole through which the first feed via 120*a* penetrates is disposed between the patch antenna pattern 110*a* and the first feed line 221*a*.

Accordingly, an electromagnetic isolation between the first feed line 221*a* and the patch antenna pattern 110*a* is improved, thereby reducing electromagnetic noise of an RF signal radiated from the first feed line 221.

The ground plane 201*a* acts as an electromagnetic wave reflector for electromagnetic waves radiated from the patch antenna pattern 110*a*, causing a radiation pattern of the patch antenna pattern 110*a* to be further concentrated in an upward direction.

The upper coupling pattern 115*a* is spaced apart from the patch antenna pattern 110*a* in an upward direction. The upper coupling pattern 115*a* provides additional capacitance and inductance to the patch antenna pattern 110*a*. The additional capacitance and inductance provides an additional resonant frequency to the patch antenna pattern 110*a*, thereby increasing a bandwidth of the patch antenna pattern 110*a*.

There may be two or more upper coupling patterns 115*a*. The bandwidth of the patch antenna pattern 110*a* increases as the number of upper coupling patterns 115*a* increases. In the example illustrated in FIG. 2, there are three upper coupling patterns 115*a*.

There may be two or more side coupling patterns 130*a* disposed on each of two opposite sides of the patch antenna pattern 110*a*. For example, one of the side coupling patterns 130*a* is disposed at the same height as the patch antenna pattern 110*a* on each of the two opposite sides of the patch antenna pattern 110*a*, and the other ones of the side coupling patterns 130*a* are disposed at the same heights as the upper coupling patterns 115*a* on each of the two opposite sides of the side coupling patterns 130*a*. In the example illustrated in FIG. 2, there are four side coupling patterns 130*a* on each of the two opposite side of the patch antenna pattern 110*a*.

The layers and vias illustrated in FIG. 2 are made of a metal. Insulating layers are disposed between the metal layers. Thus, the structure illustrated in FIG. 2 has a structure similar to a structure of a printed circuit board (PCB) in which a plurality of metal layers having patterns are interleaved with a plurality of insulating layers.

Each of the upper coupling patterns 115*a* and each of the side coupling patterns 130*a* provides additional capacitance and inductance to the patch antenna pattern 110*a*, thereby further increasing the bandwidth of the patch antenna pattern 110*a*.

Figure 3A:
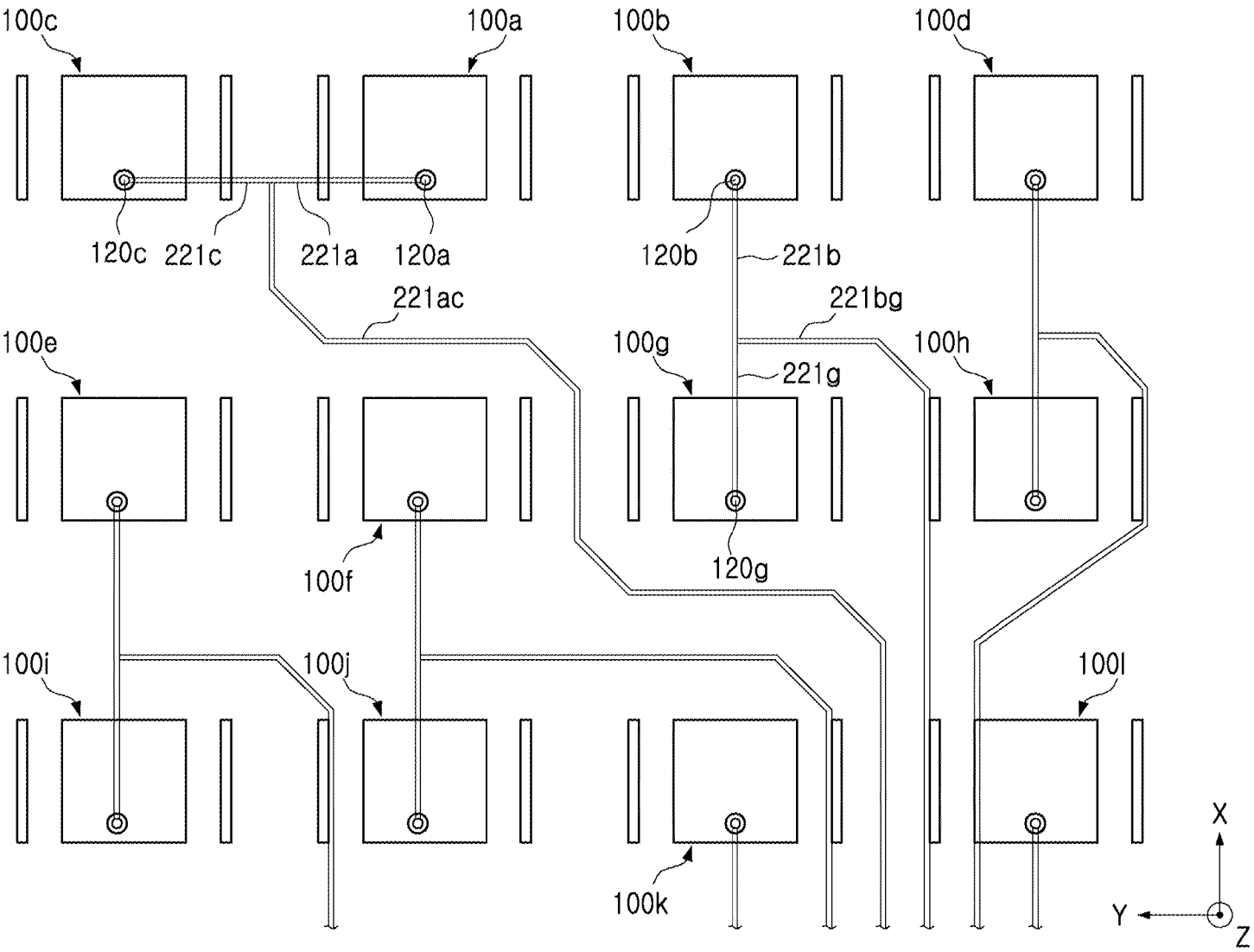
FIGS. 3A to 3C are top views illustrating examples of an N×M matrix structure of an antenna apparatus.
Figure 3B:
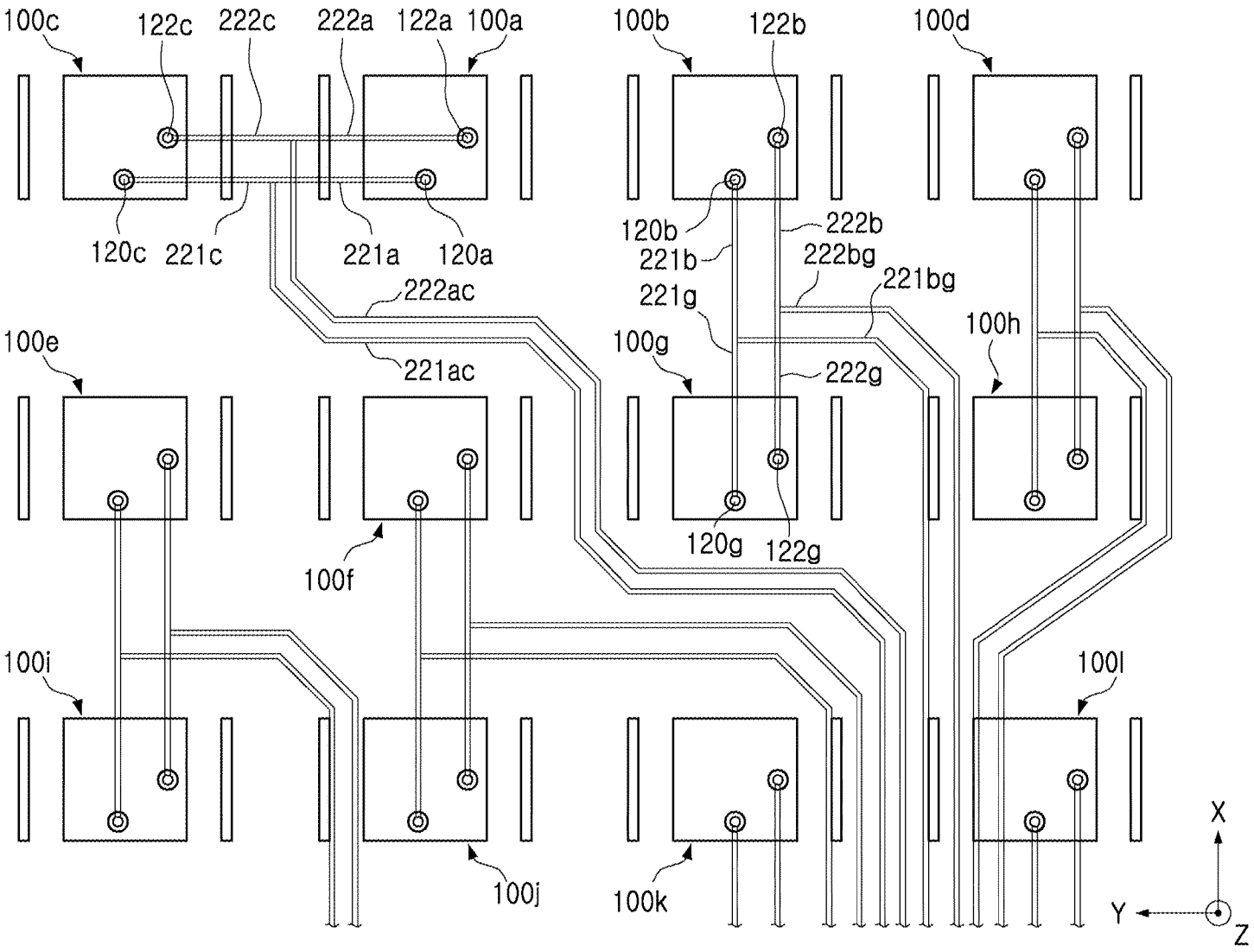
Figure 3C:
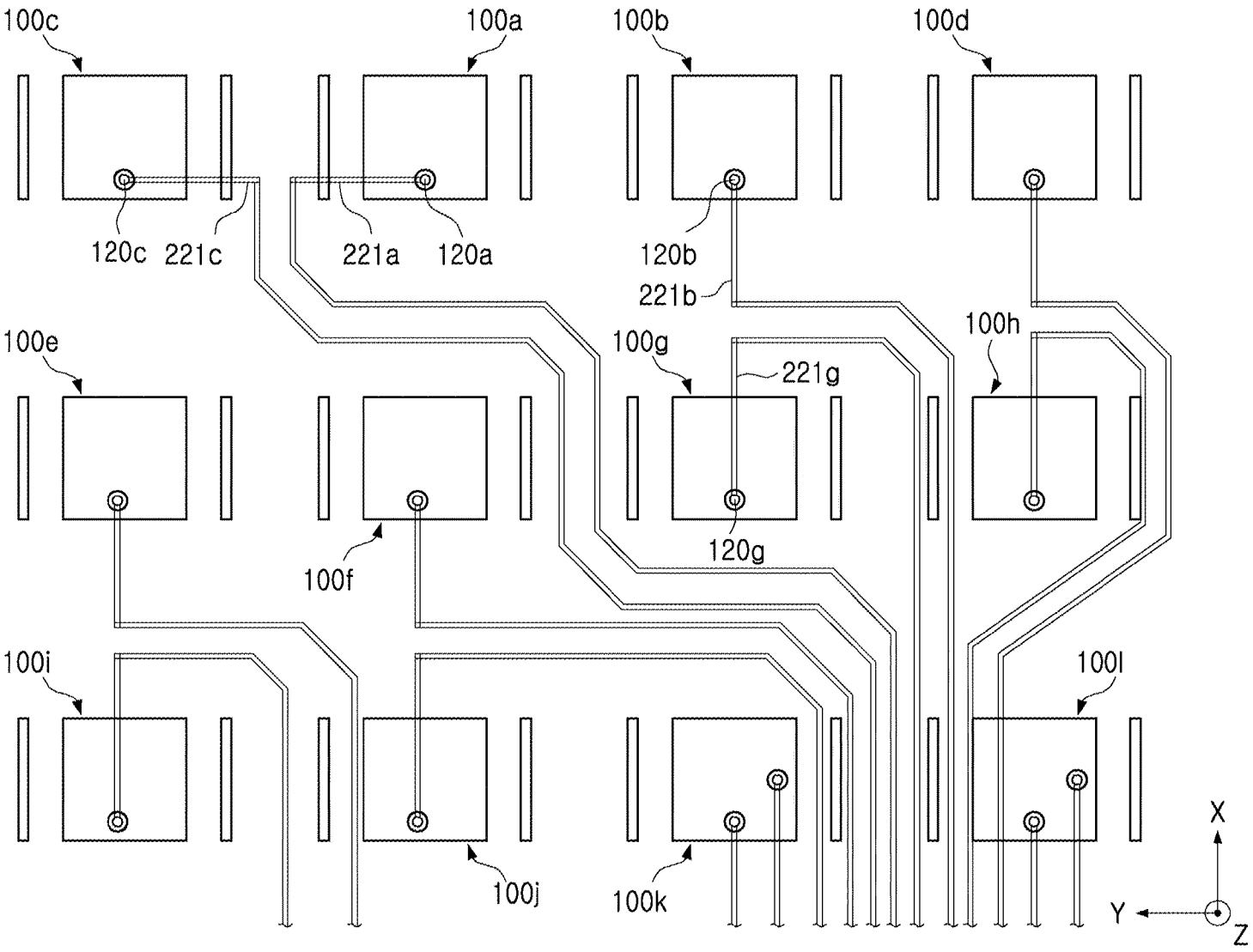

FIGS. 3A to 3C are top views illustrating examples of an N×M matrix structure of an antenna apparatus.

Referring to FIGS. 3A to 3C, an antenna apparatus includes a first antenna portion 100*a*, a second antenna portion 100*b*, a third antenna portion 100*c*, a fourth antenna portion 100*d*, a fifth antenna portion 100*e*, a sixth antenna portion 100*f*, a seventh antenna portion 100*g*, an eighth antenna portion 100*h*, a ninth antenna portion 100*i*, a tenth antenna portion 100*j*, an eleventh antenna portion 100*k*, and a twelfth antenna portion 100*l*.

The first to twelfth antenna portions 100*a*, 100*b*, 100*c*, 100*d*, 100*e*, 100*f*, 100*g*, 100*h*, 100*i*, 100*j*, 100*k*, and 100*l* are disposed in an N×M matrix structure, where N is 4 in the Y direction and M is 3 in the X direction.

Each of the first to twelfth antenna portions 100*a*, 100*b*, 100*c*, 100*d*, 100*e*, 100*f*, 100*g*, 100*h*, 100*i*, 100*j*, 100*k*, and 100*l* includes a patch antenna pattern receiving a vertical feed energy component supplied by a corresponding feed via electrically connected to the patch antenna pattern and a horizontal feed energy component supplied by a corresponding feed line electrically connected to the corresponding feed via.

The first and third antenna portions 100*a* and 100*c* belong to a first group of antenna portions, and the second and fourth to twelfth antenna portions 100*b*, 100*d*, 100*e*, 100*f*, 100*g*, and 100*h*, 100*i*, 100*j*, 100*k*, 100*l* belong to a second group of antenna portions.

Angles between directions in which first feed lines 221*a* and 221*c* of the first group extend from corresponding first feed vias 120*a* and 120*c* of the first group and directions in which first feed lines 221*b* and 221*g* of the second group extend from corresponding first feed vias 120*b* and 120*g* of the second group are not zero degrees and are not 180 degrees.

Each of the patch antenna patterns of the first group of antenna portions receives the horizontal feed energy component only in a first direction or in a direction opposite to the first direction, and each of the patch antenna patterns of the second group of antenna portions receives the horizontal feed energy component only in a second direction perpendicular to the first direction or in a direction opposite to the second direction.

Accordingly, a radiation pattern generated by the plurality of patch antenna patterns of the first to twelfth antenna portions 100*a*, 100*b*, 100*c*, 100*d*, 100*e*, 100*f*, 100*g*, 100*h*, 100*i*, 100*j*, 100*k*, and 100*l* has substantially no side lobe.

Referring to FIGS. 3A and 3B, in the first group, a direction in which the first feed line 221*a* extends from the corresponding first feed via 120*a* is opposite to a direction in which the first feed line 221*c* extends from the corresponding first feed via 120*c*. One end of a first coupling feed line 221*ac* is electrically connected to ends of the first feed lines 221*a* and 221*c*, and the other end of the first coupling feed line 221*ac* is electrically connected to a corresponding first wiring via (not shown).

In the second group, a direction in which the first feed line 221*b* extends from the corresponding first feed via 120*b* is opposite to a direction in which the first feed line 221*g* extends from the corresponding first feed via 120*b*. One end of a first coupling feed line 221*bg* is electrically connected to ends of the first feed lines 221*b* and 221*g*, and the other end of the first coupling feed line 221*bg* is electrically connected to a corresponding first wiring via (not shown).

The use of the first coupling feed line 221*ac* and the second coupling feed line 221*bg* reduces the number of feed lines that run all the way to the first wiring vias, thereby reducing the transmission loss of the RF signal in the feed lines and the total area occupied by the feed lines.

Referring to FIG. 3B, in the first group, a direction in which a second feed line 222*a* extends from a corresponding second feed via 122*a* is opposite to a direction in which a second feed line 222*c* extends from a corresponding second feed via 122*c*. One end of a second coupling feed line 222*ac* is connected to ends of the second feed lines 222*a* and 222*c*, and the other end of the second coupling feed line 222*ac* is electrically connected to a corresponding second wiring via (not shown).

In the second group, a direction in which a second feed line 222*b* extends from a corresponding second feed via 122*b* is opposite to a direction in which a second feed line 222*g* extends from a corresponding second feed via 122*g*. One end of a second coupling feed line 222*bg* is connected to ends of the second feed lines 222*b* and 222*g*, and the other end of the second coupling feed line 222*bg* is electrically connected to a corresponding second wiring via (not shown).

Referring to FIG. 3C, the first coupling feed lines 221*ac* and 221*bg* of FIG. 3A have been omitted. Accordingly, the first feed lines 221*a* and 221*c* of the first group and the first feed lines 122*b* and 122*g* of the second group are directly connected to corresponding first wiring vias (not shown).

Figure 4:
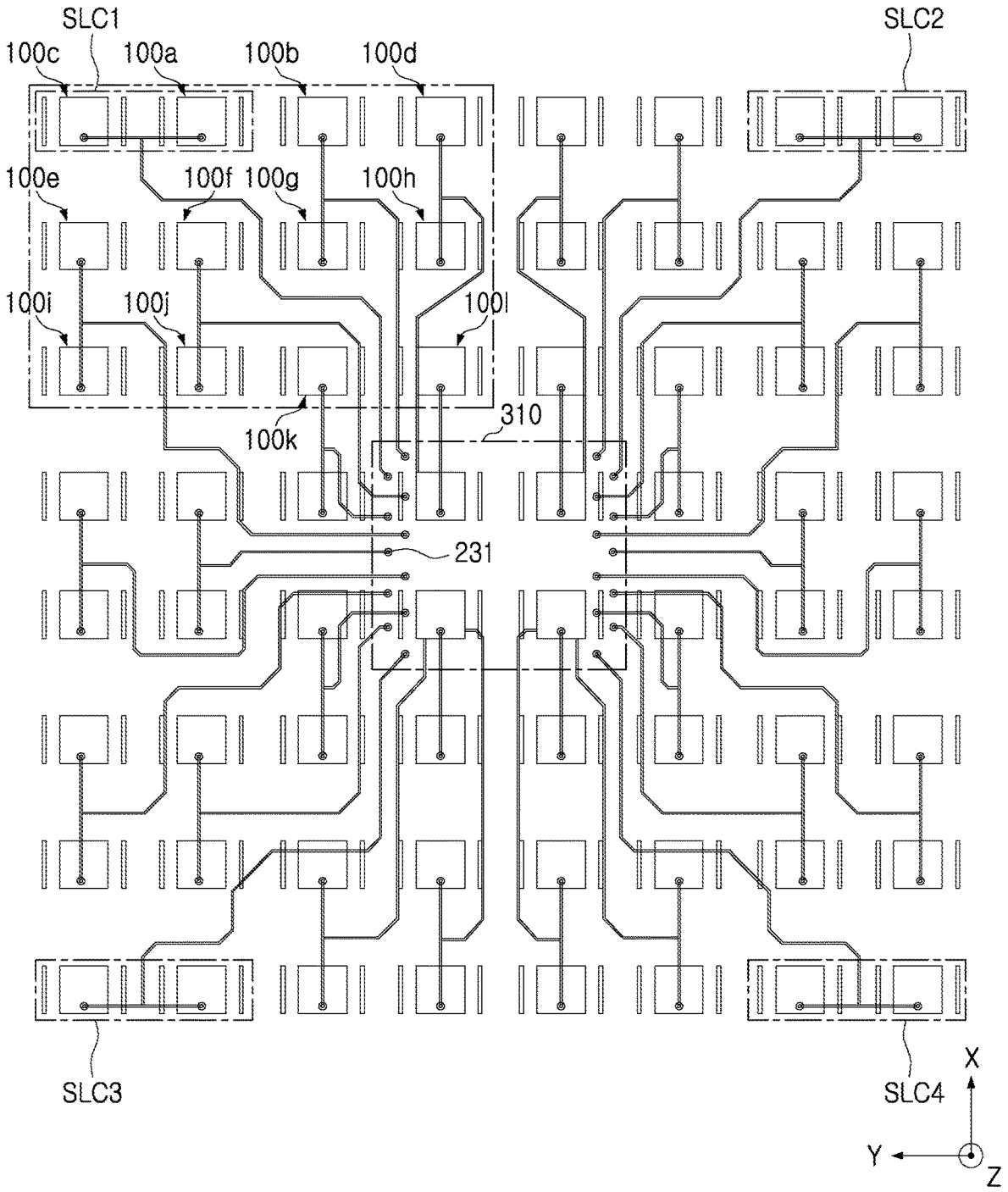
FIG. 4 is a top view illustrating another example of an N×M matrix structure of an antenna apparatus including the N×M matrix structure of an antenna apparatus of FIG. 3A disposed in the upper left corner.

FIG. 4 is a top view illustrating another example of an N×M matrix structure of an antenna apparatus including the N×M matrix structure of an antenna apparatus of FIG. 3A disposed in the upper left corner. FIG. 5A illustrates an example of a radiation pattern having a side lobe generated by a plurality of patch antenna patterns of a plurality of antenna portions having a uniform feed structure disposed in an N×M matrix structure. FIG. 5B illustrates an example of a radiation pattern having substantially no side lobe generated by a plurality of patch antenna patterns of a plurality of antenna portions having a mixed feed structure disposed in an N×M matrix structure.

Referring to FIG. 4, an antenna apparatus includes 64 antenna portions disposed in an N×M matrix structure, where N is 8 in the Y direction and M is 8 in the X direction. The 64 antenna portions include the first to twelfth antenna portions 100*a*, 100*b*, 100*c*, 100*d*, 100*e*, 100*f*, 100*g*, 100*h*, 100*i*, 100*j*, 100*k*, and 100*l* of FIG. 3A, which are disposed in an N×M matrix structure, where N is 4 in the Y direction and M is 3 in the X direction, and are disposed in the upper left corner of the N×M matrix structure of FIG. 4.

Although FIG. 4 shows an 8×8 matrix structure, this is just one example of an N×M matrix structure of antenna portions in an antenna apparatus. In more general terms, an antenna apparatus may include antenna portions disposed in an N×M matrix structure, where N is a positive integer greater than or equal to 3, and M is a positive integer greater than or equal to 2.

The 64 antenna portions are divided into a first group of antenna portions and a second group of antenna portions.

The first group consists of eight antenna portions including two antenna portions in a first corner region SLC1 in the upper left corner of the N×M matrix structure; two antenna portions in a second corner region SLC2 in the upper right corner of the N×M matrix structure; two antenna portions in a third corner region SLC3 in the lower left corner of the N×M matrix structure; and two antenna portions in a fourth corner region SLC4 in the lower right corner of the N×M matrix structure.

The second group consists of the 56 antenna portions that are not in the first group.

Each of the 64 antenna portions includes a patch antenna pattern and two side coupling patterns disposed on opposite sides of the patch antenna pattern as in the antenna portions of FIG. 3A.

The antenna apparatus further includes wiring vias 231 and an IC 310 electrically connected to the wiring vias 231. The patch antenna patterns of the eight antenna portions of the first group are connected to corresponding ones of the wiring vias 231 by feed vias, feed lines, and coupling feed lines like the first feed via 120*a*, the first feed line 221*a*, and the first coupling feed line 221*ac* of FIG. 3A. The patch antenna patterns of the 56 antenna portions of the second group are connected to corresponding ones of the wiring vias 231 by feed vias, feed lines, and coupling feed lines like the first feed via 120*b*, the first feed line 221*b*, and the first coupling feed line 221*bg* of FIG. 3A.

Regarding the eight antenna portions of the first group, the first corner region SLC1 includes the (1,1)-th and (1,2)-th antenna portions of the N×M matrix structure; the second corner region SLC2 includes the (1,N−1)-th and (1,N)-th antenna portions of the N×M matrix structure; the third corner region SLC3 includes the (M,1)-th and (M,2)-th antenna portions of the N×M matrix structure; and the fourth corner region SLC4 includes the (M,N−1)-th and (M,N)-th antenna portions of the N×M matrix structure.

Depending on a design of the antenna apparatus, at least one of the first, second, third, and fourth corner regions SLC1, SLC2, SLC3, and SLC4 of the first group may belong to the second group rather than the first group.

The (1,1)-th, (1,N)-th, (M,1)-th, and (M,N)-th antenna portions of the N×M matrix structure are adjacent to only two other antenna portions in the X and Y directions. In contrast, all of the other antenna portions of the N×M matrix structure are adjacent to three or four other antenna portions in the X and Y directions. This causes characteristics of surface currents of the patch antenna patterns of the (1,1)-th, (1,N)-th, (M,1)-th, and (M,N)-th antenna portions of the N×M matrix structure to be slightly different from characteristics of surface currents of the patch antenna patterns of the other antenna portions of the N×M matrix structure.

Figure 5A:
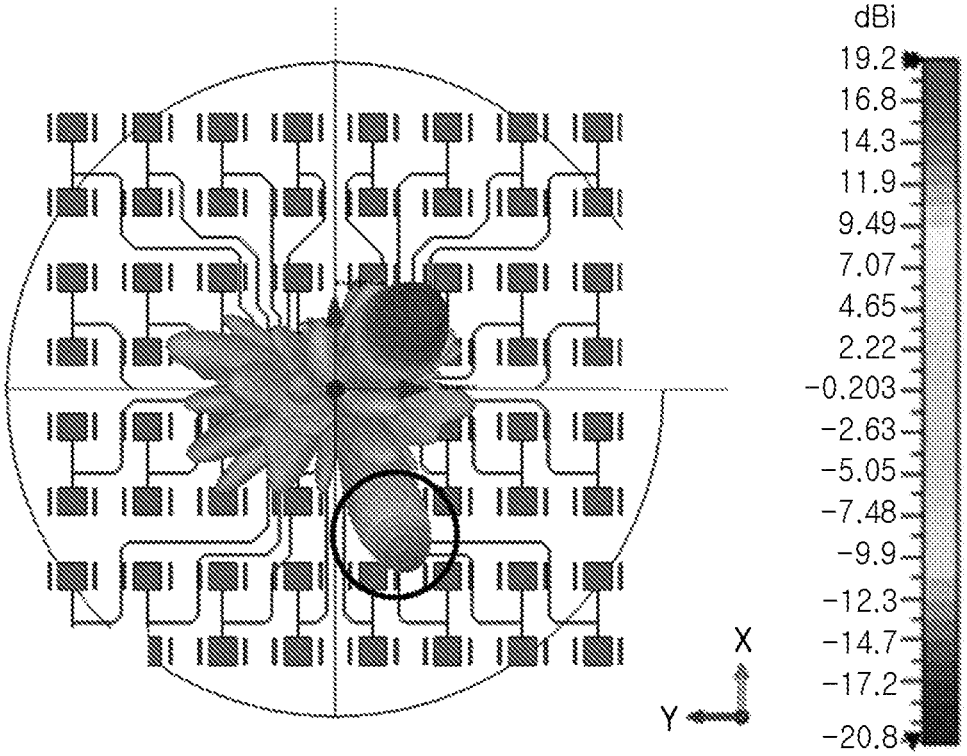
FIG. 5A illustrates an example of a radiation pattern having a side lobe generated by a plurality of patch antenna patterns of a plurality of antenna portions having a uniform feed structure disposed in an N×M matrix structure.

Referring to FIG. 5A, a plurality of antenna portions each including a patch antenna pattern are disposed in an N×M matrix structure, where N is 8 in the Y direction and M is 8 in the X direction. The plurality of antenna portions of FIG. 5A have a uniform feed structure in which each of the patch antenna patterns receives a horizontal feed energy component only in a second direction (the Y direction) or in a direction opposite to the second direction. The slight difference between the characteristics of the surface currents of the patch antenna patterns of the (1,1)-th, (1,N)-th, (M,1)-th, and (M,N)-th antenna portions of the N×M matrix structure and the characteristics of the surface currents of the patch antenna patterns of the other antenna portions of the N×M matrix structure causes a radiation pattern generated by the patch antenna patterns of the plurality of antenna portions of the N×M matrix structure to have a side lobe as illustrated by the small circle in FIG. 5A.

In contrast, the plurality of antenna portions of FIG. 4 have a mixed feed structure in which the patch antenna patterns of the first group of antenna portions receive a horizontal feed energy component only in a first direction or in a direction opposite to the first direction, and each of the patch antenna patterns of the second group of antenna portions receives a horizontal feed energy component only in a second direction perpendicular to the first direction or in a direction opposite to the second direction.

The mixed feed structure of the plurality of antenna portions of FIG. 4 compensates for the slight difference between the characteristics of the surface currents of the patch antenna patterns of the (1,1)-th, (1,N)-th, (M,1)-th, and (M,N)-th antenna portions of the N×M matrix structure and the characteristics of the surface currents of the patch antenna patterns of the other antenna portions of the N×M matrix structure, thereby causing a radiation pattern generated by patch antenna patterns of the of the plurality of antenna portions of the N×M matrix structure to have substantially no side lobe.

Figure 5B:
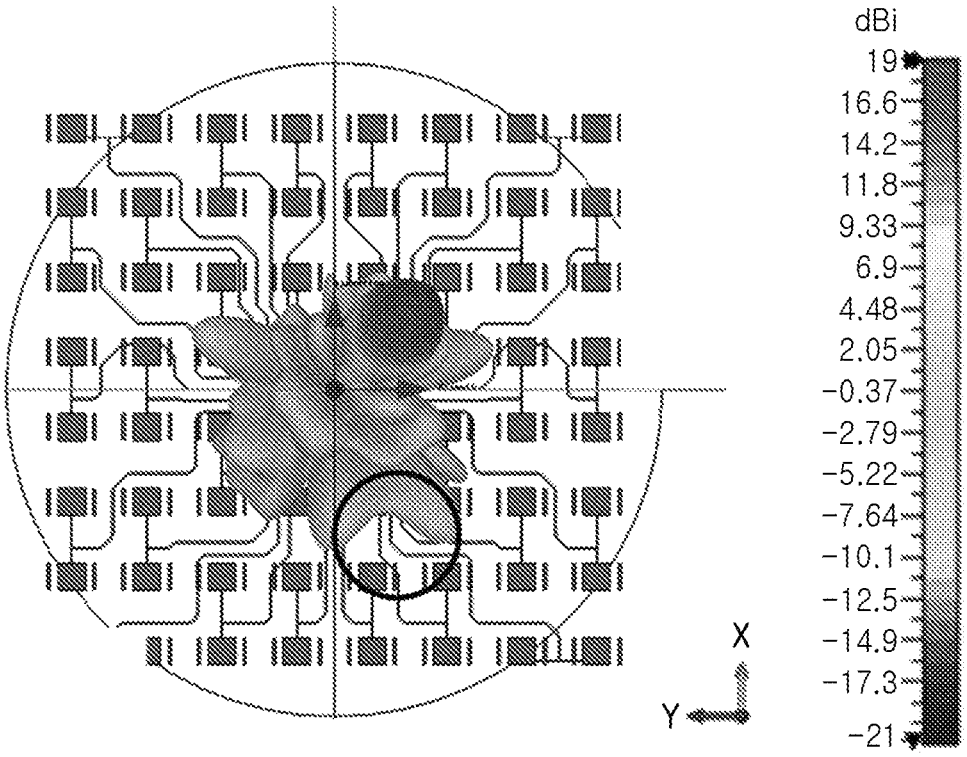
FIG. 5B illustrates an example of a radiation pattern having substantially no side lobe generated by a plurality of patch antenna patterns of a plurality of antenna portions having a mixed feed structure disposed in an N×M matrix structure.

Referring to FIG. 5B, a plurality of antenna portions each including a patch antenna pattern are disposed in an N×M matrix structure, where N is 8 in the Y direction and M is 8 in the X direction. The plurality of antenna portions of FIG. 5B have the same mixed feed structure as the plurality of antenna portions of FIG. 4. Therefore, a radiation pattern generated by the patch antenna patterns of the plurality of antenna portions of the N×M matrix structure has substantially no side lobe as illustrated by the small circle in FIG. 5B.

In the mixed feed structure of the plurality of antenna portions of the N×M matrix structure of FIG. 4, the two patch antenna patterns in each of the corner regions SLC1, SLC2, SLC3, and SLC4 of the N×M matrix structure are connected to each other by one feed line extending in the Y direction, and one feed line extending in a direction opposite to the Y direction. The remaining patch antenna patterns are divided into pairs of patch antenna patterns. The two patch antenna patterns in each of the pairs are adjacent to each other in the X direction, and are connected to each other by one feed line extending in the X direction, and one feed line extending in a direction opposite to the X direction.

In order to be able to implement the mixed feed structure illustrated in FIG. 4 for a plurality of antenna portions disposed in an N×M matrix structure, N must be a positive integer greater than or equal to 4, and M must be a positive even integer greater than or equal to 4. Thus, examples of sizes of an N×M matrix structure that enable the mixed feed structure to be implemented are 4×4, 5×4, 6×4, 7×4, 8×4, 4×6, 5×6, 6×6, 7×6, 8×6, 4×8, 5×8, 6×8, 7×8, and 8×8, but are not limited thereto.

Figure 6A:
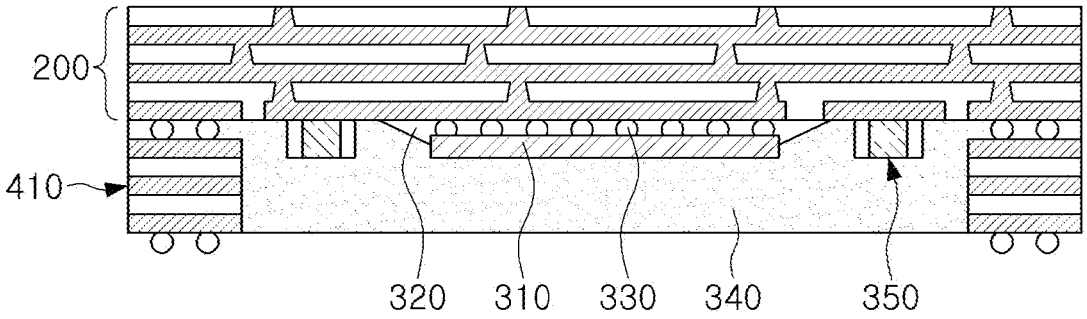
FIGS. 6A and 6B are side views illustrating examples of a connection member included in an antenna apparatus and a structure on a bottom surface of the connection member.
Figure 6B:
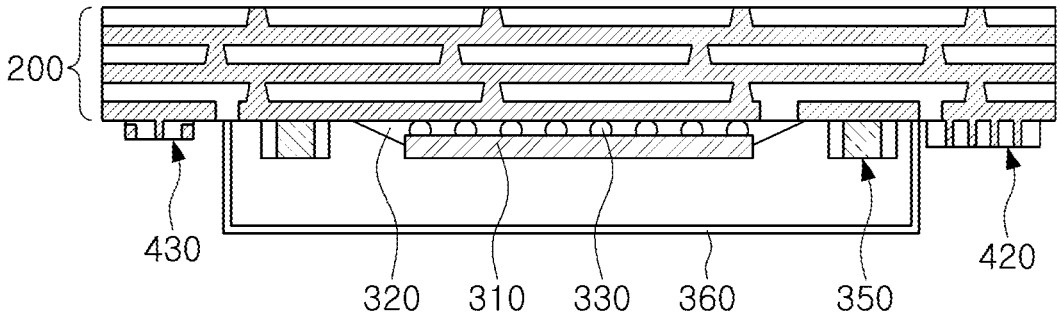

FIGS. 6A and 6B are side views illustrating examples of a connection member included in an antenna apparatus and a structure on a bottom surface of the connection member.

Referring to FIG. 6A, an antenna apparatus includes at least a portion of a connection member 200, an IC 310, an adhesive member 320, an electrical connection structure 330, an encapsulant 340, passive components 350, and a core member 410.

Although not illustrated in FIG. 6A for simplicity of illustration, the antenna apparatus further includes one or more patch antenna patterns corresponding to one or more of the patch antenna patterns of FIGS. 1A to 4 disposed above the connection member 200, one or more feed vias electrically connecting the one or more patch antenna patterns to one or more feed lines in the connection member, which electrically connect the one or more feed vias to one or more wiring vias in the connection member 200 in accordance with feed structures described with respect to FIGS. 1A to 4.

The connection member 200 has a structure similar to the connection member 200 of FIG. 2, and has a structure in which a plurality of metal layers having patterns and a plurality of insulating layers are laminated, like in a printed circuit board (PCB).

The IC 310 corresponds to the IC 310 described above in connection with FIGS. 1A, 2, and 4, and is mounted on a bottom surface of the connection member 200. The IC 310 is electrically connected to wiring vias of the connection member 200, for example, the first wiring visas 231*a* and 231*b* of FIG. 1A, the first wiring visa 231*a* of FIG. 2, the unillustrated first wiring vias described in connection with FIGS. 3A and 3B, the unillustrated second wiring vias described in connection with FIG. 3B, the wiring vias 231 of FIG. 4, or to unillustrated circuit patterns and ground patterns of the connection member 200, to transmit and receive RF signals, and is electrically connected to one or more ground planes or ground patterns of the connection member 200 to receive a ground. For example, the IC 310 may perform at least some of frequency conversion, amplification, filtering, phase control, and power generation to generate an RF signal from an intermediate frequency (IF) signal or a baseband signal, and generate an IF signal or a baseband signal from an RF signal.

The adhesive member 320 bonds the IC 310 and the connection member 200 to each other.

The electrical connection structure 330 electrically connects the IC 310 and the connection member 200 to each other. For example, the electrical connection structure 330 may have a structure such as solder balls, pins, lands, and pads. The electrical connection structure 330 has a melting point lower than a melting point of the wiring vias, the circuit patterns, the ground planes, and the ground patterns of the connection member 200, thereby enabling the IC 310 and the connection member 200 to be electrically connected to each other using a predetermined joining process making use of the lower melting point of the electrical connection structure 330.

The encapsulant 340 encapsulates the IC 310, and improves the heat radiation performance and the impact protection performance of the IC 310. For example, the encapsulant 340 may be a photoimageable encapsulant (PIE), Ajinomoto Build-up film (ABF), or an epoxy molding compound (EMC).

The passive components 350 are mounted on the bottom surface of the connection member 200, and are electrically connected to either one or both of the circuit patterns and the ground planes or ground patterns of the connection member 200 through an electrical connection structure (not shown). For example, the passive components 350 may be a capacitor (for example, a multilayer ceramic capacitor (MLCC)), an inductor, or a chip resistor. The encapsulant 340 also encapsulates the passive components 350.

The core member 410 is disposed below the connection member 200, and is electrically connected to the connection member 200 to receive an IF signal or a baseband signal from an external component and transmit the IF signal or the baseband signal to the IC 310, and receive an IF signal or a baseband signal from the IC 310 and transmit the IF signal or the baseband signal to the external component. A frequency of the RF signal (for example, 24 GHz, 28 GHz, 36 GHz, 39 GHz, or 60 GHz) is higher than a frequency of the IF signal (for example, 2 GHz, 5 GHz, or 10 GHz).

For example, the core member 410 may transmit an IF signal or a baseband signal to the IC 310, or may receive an IF signal or a baseband signal from the IC 310 through circuit patterns and ground patterns of an IC ground plane of the connection member 200, which corresponds to the fourth ground plane 204*a* of FIG. 2. A first ground layer of the connection member 200, which corresponds to the ground plane 201*a* of FIG. 2, is disposed between the IC ground plane and one or more patch antenna patterns (not shown) disposed above the connection member 200, which correspond to one or more of the patch antenna patterns of FIGS. 1A-4, thereby electrically isolating the IF signal or the baseband signal from the RF signals transmitted or received by the one or more patch antenna patterns.

Referring to FIG. 6B, an antenna apparatus is similar to the antenna apparatus of FIG. 6A, but omits the core member 410 of FIG. 6A, and further includes a shielding member 360, a connector 420, and an end-fire chip antenna 430.

The shielding member 360 is mounted on the bottom surface of the connection member 200 to shield the IC 310 together with the passive components 350 and a portion of the connection member 200. For example, the shielding member 360 may be disposed to conformally shield the IC 310 and the passive components 350 together as shown in FIG. 6B, or compartmentally shield the IC 310 and the passive components 350 individually. For example, the shielding member 360 may have a hexahedral shape with one open side, and may form a hexahedral receiving space through bonding to the connection member 200. The shielding member 360 may be made of a material having a high conductivity such as copper so that the shielding member 360 has a shallow skin depth, and is electrically connected to one of the ground planes of the connection member 200. Accordingly, the shielding member 360 reduces electromagnetic noise applied to the IC 310 and the passive components 350.

The connector 420 is a connector for a cable (for example, a coaxial cable or a flexible PCB), is electrically connected to the IC ground plane of the connection member 200, and performs a function similar to a function of the core member 410 of FIG. 6A. For example, the connector 420 may receive an IF signal or a baseband signal and power from the cable, and may output an IF signal or a baseband signal and power to the cable.

The end-fire chip antenna 430 transmits and receives an RF signal to assist the antenna apparatus. For example, the end-fire chip antenna 430 includes a dielectric block having a dielectric constant greater than a dielectric constant of insulating layers of the connection member 200, and two electrodes disposed on opposite surfaces of the dielectric block. One of the two electrodes is electrically connected to one of the circuit patterns of the connection member 200, and the other one of the two electrodes is electrically connected to one of the ground planes or ground patterns of the connection member 200.

Figure 7:
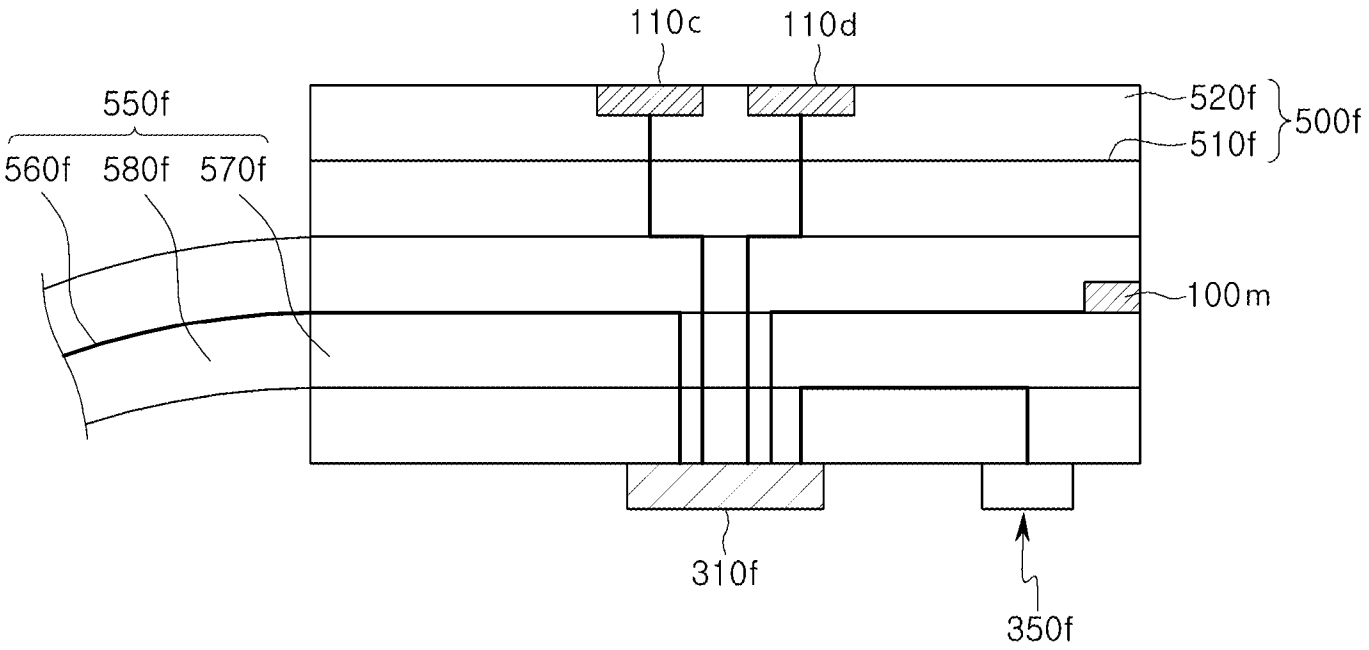
FIG. 7 is a side view illustrating an example of a structure of an antenna apparatus.

FIG. 7 is a side view illustrating an example of a structure of an antenna apparatus.

Referring to FIG. 7, an antenna apparatus has a structure in which an end-fire antenna 100*m*, patch antenna patterns 110*c* and 110*d*, an IC 310*f*, and a passive component 350*f* are integrated with a connection member 500*f*.

The patch antenna patterns 110*c* and 110*d* may be the patch antenna patterns 110*a* and 110*b* of any of FIGS. 1A to 1D, or may be the patch antenna patterns of the antenna portions of any of FIGS. 3A to 4, although only two patch antenna patterns 110*c* and 110*d* are shown in FIG. 7 for simplicity of illustration. The end-fire antenna 100*m* and the patch antenna patterns 110*c* and 110*d* receive RF signals from the IC 310*f* and transmit received RF signals to the IC 310*f*.

The connection member 500*f* has a structure in which conductive layers 510*f* and insulating layers 520*f* are laminated (like, for example, a structure of a printed circuit board). The conductive layers 510*f* include ground planes, circuit patterns, ground patterns, and feed lines as described above in connection with FIGS. 2 and 4.

The antenna apparatus further includes a flexible connection member 550*f*. The flexible connection member 550*f* includes a first flexible region 570*f* that overlaps the connection member 500*f*, and a second flexible region 580*f* that does not overlap the connection member 500*f*, when viewed in a vertical direction.

The second flexible region 580*f* is bendable in the vertical direction. Accordingly, the second flexible region 580*f* may be flexibly connected to a connector of a substrate (not shown) or to an adjacent antenna apparatus (not shown).

The flexible connection member 550*f* further includes a signal line 560*f*. An IF signal or a baseband signal is transmitted to the IC 310*f* through the signal line 560*f* from the connector of the substrate or the adjacent antenna apparatus, and an IF signal or a baseband signal is transmitted to the connector of the substrate or the adjacent antenna apparatus through the signal line 560*f* from the IC 310*f*.

Figure 8A:
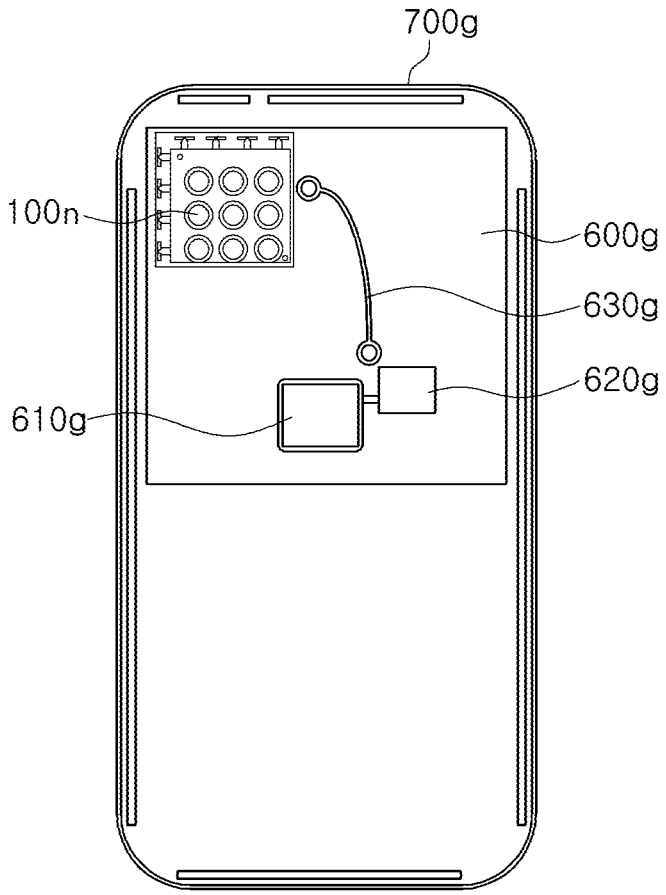
FIGS. 8A to 8C are top views illustrating examples of an arrangement of an antenna apparatus in an electronic device.
Figure 8B:
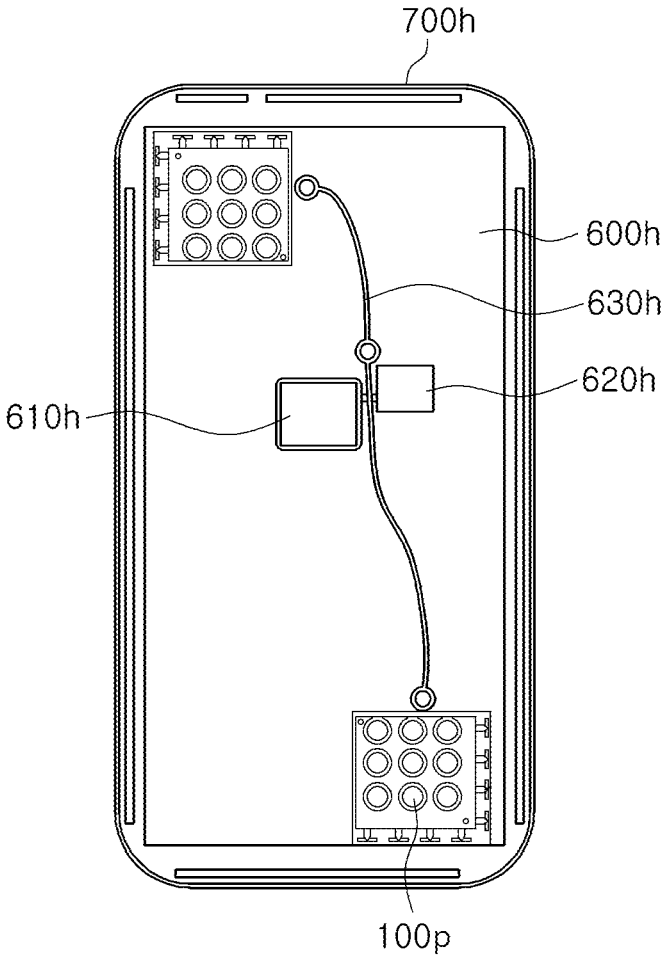
Figure 8C:
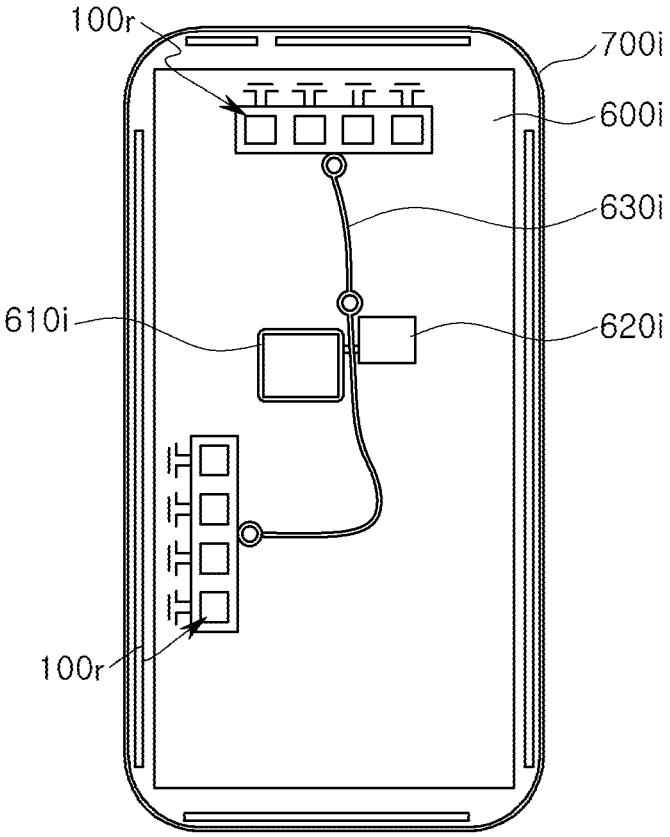

FIGS. 8A to 8C are top views illustrating examples of an arrangement of an antenna apparatus in an electronic device.

Referring to FIG. 8A, an antenna apparatus including antenna portions 100*n* each including a patch antenna pattern is disposed in an inner corner of a rectangular case of an electronic device 700*g* on a substrate 600*g* of the electronic device 700*g*.

The electronic device 700*g* may be a smartphone, a personal digital assistant, a digital video camera, a digital still camera, a network system, a computer, a monitor, a tablet, a laptop, a netbook, a television, a video game, a smartwatch, or an automotive component, but is not limited thereto.

A communications module 610*g* and a baseband circuit 620*g* are also disposed on the substrate 600*g*. The antenna apparatus is electrically connected to either one or both of the communications module 610*g* and the baseband circuit 620*g* by a coaxial cable 630*g*.

The communications module 610*g* includes at least some of a memory chip such as a volatile memory (for example, a dynamic random-access memory (DRAM)) or a non-volatile memory (for example, a read-only memory (ROM) or a flash memory); an application processor chip such as a central processor (for example, a central processing unit (CPU)), a graphics processor (for example, a graphics processing unit (GPU)), a digital signal processor, a cryptographic processor, a microprocessor, or a microcontroller); and a logic chip such as an analog-digital converter or an application-specific IC (ASIC).

The baseband circuit 620*g* generates an IF signal or a baseband signal by performing analog-digital conversion, amplification, filtering, and frequency conversion on an analog signal, and the IF signal or the baseband signal is transmitted from the baseband circuit 620*g* to the antenna apparatus through the coaxial cable 630*g*. Also, the baseband circuit 620*g* generates an analog signal by performing frequency conversion, filtering, amplification, and digital-analog conversion on an IF signal or a baseband signal transmitted from the antenna apparatus to the baseband circuit 620*g* through the coaxial cable 630*g*.

For example, the IF signal or the baseband signal may be transmitted to or received from an IC of the antenna apparatus corresponding to the unillustrated IC described in connection with FIG. 1A, the IC 310 of FIGS. 4, 6A, and 6B, or the IC 310*f* of FIG. 7, through an electrical connection structure, wiring vias, feed lines, and feed vias. The IC converts the IF signal or the baseband signal into an RF signal in a millimeter wave (mmWave) band to be transmitted, and converts a received RF signal in an mmWave band into an IF signal or a baseband signal.

Referring to FIG. 8B, two antenna apparatuses each including antenna portions 100*p* each including patch antenna patterns are disposed in diagonally opposite inner corners of a rectangular case of an electronic device 700*h* on a substrate 600*h* of the electronic device 700*h*. A communications module 610*h* and a baseband circuit 620*h* are further disposed on the substrate 600*h*. The antenna apparatuses are electrically connected to either one or both of the communications module 610*h* and the baseband circuit 620*h* by coaxial cables 630*h*.

Referring to FIG. 8C, two antenna apparatuses each including antenna portions 100*r* each including patch antenna patterns are disposed adjacent to adjacent inner sides of a rectangular case of an electronic device 700*i* on a substrate 600*i* of the electronic device 700*i*. A communications module 610*i* and a baseband circuit 620*i* are further disposed on the substrate 600*i*. The antenna apparatuses are electrically connected to either one or both of the communications module 610*i* and the baseband circuit 620*i* by coaxial cables 630*i*.

The patch antenna patterns, the upper coupling patterns, the side coupling patterns, the feed vias, the wiring vias, the shielding vias, the feed lines, the coupling feed lines, the ground planes, the circuit patterns, the ground patterns, the electrodes of the end-fire chip antenna, and the electrical connection structures disclosed herein may include a metal material (for example, a conductive material such as copper (Cu), aluminum (Al), silver (Ag), tin (Sn), gold (Au), nickel (Ni), lead (Pb), titanium (Ti), or an alloy of any two or more thereof), and may be formed by a plating method such as chemical vapor deposition (CVD), physical vapor deposition (PVD), sputtering, a subtractive process, an additive process, a semi-additive process (SAP), or a modified semi-additive process (mSAP). However, the plating method is not limited thereto.

The insulating layers described in connection with FIGS. 2 and 6A and the insulating layers 520*f* of FIG. 7 may be made of a liquid crystal polymer (LCP), a low temperature co-fired ceramic (LTCC), a thermosetting resin such as an epoxy resin, a thermoplastic resin such as a polyimide resin, a resin such as a thermosetting resin or a thermoplastic resin impregnated together with an organic filler into a core material such as glass fiber, glass cloth, or glass fabric, prepregs, Ajinomoto Build-Up Film (ABF), FR-4, a bismaleimide triazine (BT) resin, a photoimageable dielectric (PID) resin, a copper-clad laminate (CCL), or a glass- or ceramic-based insulating material.

The RF signals disclosed herein may have a format according to Wi-Fi (IEEE 802.11 family), Worldwide Interoperability for Microwave Access (WiMAX) (IEEE 802.16 family), IEEE 802.20, Long Term Evolution (LTE), Evolution-Data Optimized (EV-DO), Evolved High Speed Packet Access (HSPA+), High Speed Downlink Packet Access (HSDPA), High Speed Uplink Packet Access (HSUPA), Enhanced Data Rates for GSM Evolution (EDGE), Global System for Mobile Communications (GSM), Global Positioning System (GPS), General Packet Radio Service (GPRS), Code-Division Multiple Access (CDMA), Time-Division Multiple Access (TDMA), Digital Enhanced Cordless Telecommunications (DECT), Bluetooth, 3G, 4G, 5G, and any other wireless and wired protocols, but are not limited thereto.

The examples of an antenna apparatus described herein improve antenna performance (for example, a gain, a bandwidth, and a directivity), and have a structure advantageous for miniaturization.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus comprising:

a plurality of patch antenna patterns;

a plurality of first feed vias each electrically connected to a corresponding patch antenna pattern among the plurality of patch antenna patterns; and a plurality of first feed lines each electrically connected to a corresponding first feed via among the plurality of first feed vias, wherein each of the plurality of first feed vias is electrically connected to the corresponding patch antenna pattern at a point offset from a center of the corresponding patch antenna pattern in a first direction, and an angle between a direction in which each of at least one of the plurality of first feed lines starts to extend from the corresponding first feed via and a direction in which each of remaining ones of the plurality of first feed lines starts to extend from the corresponding first feed via is not zero degrees and is not 180 degrees.

2. The antenna apparatus of claim 1, further comprising:

a plurality of first wiring vias each electrically connected to a corresponding first feed line among the plurality of first feed lines; and an integrated circuit (IC) electrically connected to the plurality of first wiring vias.

3. The antenna apparatus of claim 1, further comprising a plurality of second feed vias each electrically connected to a corresponding patch antenna pattern among the plurality of patch antenna patterns, wherein each of the plurality of second feed vias is electrically connected to the corresponding patch antenna pattern at a point offset from the center of the corresponding patch antenna pattern in a second direction different from the first direction.

4. The antenna apparatus of claim 3, further comprising a plurality of second feed lines each electrically connected to a corresponding feed via among the plurality of second feed vias, wherein an angle between a starting direction in which at least one of the plurality of second feed lines extends from the corresponding second feed via and a starting direction in which at least other one of the plurality of second feed lines extends from the corresponding second feed via is not zero degrees and is not 180 degrees.

5. The antenna apparatus of claim 1, wherein the direction in which the least one of the plurality of first feed lines starts to extend from the corresponding first feed via and the direction in which the at least other one of the plurality of first feed lines starts to extend from the corresponding first feed via are perpendicular to each other and perpendicular to the plurality of first feed vias.

6. The antenna apparatus of claim 1, further comprising a plurality of side coupling patterns disposed in a second direction together with the plurality of patch antenna patterns, wherein each of at least one of the plurality of first feed lines starts to extend from the corresponding first feed via in the second direction.

7. The antenna apparatus of claim 1, further comprising a ground plane disposed between the plurality of patch antenna patterns and the plurality of first feed lines and comprising a plurality of through-holes through which the plurality of first feed vias respectively penetrate.

8. The antenna apparatus of claim 1, further comprising a plurality of upper coupling patterns respectively spaced apart from the plurality of patch antenna patterns in an upward direction, wherein the plurality of first feed vias respectively extend from the plurality of patch antenna patterns in a downward direction.

9. The antenna apparatus of claim 8, further comprising a plurality of side coupling patterns disposed in a second direction together with the plurality of patch antenna patterns and the plurality of upper coupling patterns, wherein some of the plurality of side coupling patterns are disposed at a same height as the plurality of patch antenna patterns, and remaining ones of the plurality of side coupling patterns are disposed at same heights as the plurality of upper coupling patterns.

10. The antenna apparatus of claim 1, wherein the plurality of patch antenna patterns comprise at least four patch antenna patterns, and are divided into a first group of patch antenna patterns and a second group of patch antenna patterns, and an angle between a direction in which of each of the first feed lines corresponding to the patch antenna patterns of the first group extends from the corresponding first feed via and a direction in which each of the first feed lines corresponding to the patch antenna patterns of the second group extends from the corresponding first feed via is not zero degrees and is not 180 degrees.

11. The antenna apparatus of claim 10, wherein a direction in which at least one of the first feed lines corresponding to the patch antenna patterns of the first group extends from the corresponding first feed via is opposite to a direction in which each of remaining ones of the first feed lines corresponding to the patch antenna patterns of the first group extends from the corresponding first feed via, a direction in which at least one of the first feed lines corresponding to the patch antenna patterns of the second group extends from the corresponding first feed via is opposite to a direction in which each of remaining ones of the first feed lines corresponding to the patch antenna patterns of the second group extends from the corresponding first feed via, and the directions in which the first feed lines corresponding to the patch antenna patterns of the first group extend from the corresponding first feed vias are perpendicular to the directions in which the first feed lines corresponding to the patch antenna patterns of the second group extend from the corresponding first feed vias.

12. The antenna apparatus of claim 11, further comprising:

a plurality of coupling feed lines; and a plurality of first wiring vias, wherein each of at least one of the coupling feed lines electrically connects a respective two of the first feed lines corresponding to the patch antenna patterns of the first group and extending in opposite directions from the corresponding first feed vias to a respective one of the first wiring vias, and each of remaining ones of the coupling feed lines electrically connects a respective two of the first feed lines corresponding to the patch antenna patterns of the second group and extending in opposite directions from the corresponding first feed vias to a respective one of the first wiring vias.

13. The antenna apparatus of claim 10, wherein the plurality of patch antenna patterns are disposed in an N×M matrix structure, where N is a positive integer greater than or equal to 3, and M is a positive integer greater than or equal to 2, and the first group of patch antenna patterns comprises at least one of a (1,1)-th patch antenna pattern of the N×M matrix structure, a (1,N)-th patch antenna pattern of the N×M matrix structure, an (M,1)-th patch antenna pattern of the N×M matrix structure, and an (M,N)-th patch antenna pattern of the N×M matrix structure.

* * * * *